US008196556B2

(12) United States Patent
Hendriksma

(10) Patent No.: US 8,196,556 B2
(45) Date of Patent: Jun. 12, 2012

(54) APPARATUS AND METHOD FOR SETTING MECHANICAL LASH IN A VALVE-DEACTIVATING HYDRAULIC LASH ADJUSTER

(75) Inventor: Nick J. Hendriksma, Grand Rapids, MI (US)

(73) Assignee: Delphi Technologies, Inc., Troy, MI (US)

( * ) Notice: Subject to any disclaimer, the term of this patent is extended or adjusted under 35 U.S.C. 154(b) by 462 days.

(21) Appl. No.: 12/561,842

(22) Filed: Sep. 17, 2009

(65) Prior Publication Data

US 2011/0061615 A1 Mar. 17, 2011

(51) Int. Cl.
*F01L 1/14* (2006.01)

(52) U.S. Cl. ..... 123/90.59; 123/90.52; 123/90.16

(58) Field of Classification Search ..... 123/90.59, 123/90.52, 90.48, 90.16
See application file for complete search history.

(56) References Cited

U.S. PATENT DOCUMENTS

| | | | |
|---|---|---|---|
| 3,108,580 | A | 10/1963 | Crane |
| 3,886,808 | A | 6/1975 | Weber |
| 4,054,109 | A | 10/1977 | Herrin et al. |
| 4,083,334 | A | 4/1978 | Roncon |
| 4,089,234 | A | 5/1978 | Henson et al. |
| 4,098,240 | A | 7/1978 | Abell, Jr. |
| 4,133,332 | A | 1/1979 | Benson et al. |
| 4,164,917 | A | 8/1979 | Glasson |
| 4,207,775 | A | 6/1980 | Lintott |
| 4,228,771 | A | 10/1980 | Krieg |
| 4,231,267 | A | 11/1980 | Van Slooten |
| 4,463,714 | A | 8/1984 | Nakamura |
| 4,546,734 | A | 10/1985 | Kodama |
| 4,615,307 | A | 10/1986 | Kodama et al. |
| 4,739,675 | A | 4/1988 | Connell |
| 4,790,274 | A | 12/1988 | Inoue et al. |
| 4,905,639 | A | 3/1990 | Konno |
| 4,913,106 | A | 4/1990 | Rhoads |
| 4,941,438 | A | 7/1990 | Muto |

(Continued)

FOREIGN PATENT DOCUMENTS

| | | |
|---|---|---|
| DE | 19804952 | 8/1999 |

(Continued)

OTHER PUBLICATIONS

Buuck, Church, Hampton, "Engine Trends & Valve Train Systems for Improved Performance & Fuel Economy," Eaton Corp., Aug. 1999, 9 pages.

(Continued)

*Primary Examiner* — Zelalem Eshete
(74) *Attorney, Agent, or Firm* — Thomas N. Twomey

(57) ABSTRACT

A DHLA including a hydraulic lash adjustment mechanism disposed within a plunger slidably disposed within a pin housing that is slidably disposed within an axial bore in an adjuster body. A lash ring disposed in a groove near the outer end of the DHLA body includes a portion extending into the bore to limit travel of the pin housing and thereby set the internal mechanical lash in the DHLA. The lash ring has a thickness selected to provided a predetermined amount of mechanical lash in the assembled lifter, which thickness varies from assembly to assembly to compensate for manufacturing variation in the components. A biasing means such as a wave ring, a Belleville washer or a beveled retaining ring is also installed in the annular groove to urge the lash ring against the lower surface of the groove under all DHLA operating conditions.

10 Claims, 5 Drawing Sheets

U.S. PATENT DOCUMENTS

| | | | |
|---|---|---|---|
| 4,942,855 | A | 7/1990 | Muto |
| 5,085,182 | A | 2/1992 | Nakamura et al. |
| 5,088,455 | A | 2/1992 | Moretz |
| 5,090,364 | A | 2/1992 | McCarroll et al. |
| 5,099,806 | A | 3/1992 | Murata et al. |
| 5,245,958 | A | 9/1993 | Krieg et al. |
| 5,247,913 | A | 9/1993 | Manolis |
| 5,253,621 | A | 10/1993 | Dopson et al. |
| 5,255,639 | A | 10/1993 | Shirey et al. |
| 5,261,361 | A | 11/1993 | Speil |
| 5,307,769 | A | 5/1994 | Meagher et al. |
| 5,345,904 | A | 9/1994 | Dopson et al. |
| 5,351,662 | A | 10/1994 | Dopson et al. |
| 5,357,916 | A | 10/1994 | Matterazzo |
| 5,361,733 | A | 11/1994 | Spath et al. |
| 5,386,806 | A | 2/1995 | Hurr et al. |
| 5,398,648 | A | 3/1995 | Spath et al. |
| 5,402,756 | A | 4/1995 | Bohme et al. |
| 5,419,290 | A | 5/1995 | Hurr et al. |
| 5,429,079 | A | 7/1995 | Murata et al. |
| 5,431,133 | A | 7/1995 | Spath et al. |
| 5,501,186 | A | 3/1996 | Hara et al. |
| 5,544,626 | A | 8/1996 | Diggs et al. |
| 5,544,628 | A | 8/1996 | Voigt |
| 5,546,899 | A | 8/1996 | Sperling et al. |
| 5,555,861 | A | 9/1996 | Mayr et al. |
| 5,615,651 | A | 4/1997 | Miyachi |
| 5,651,335 | A | 7/1997 | Elendt et al. |
| 5,655,487 | A | 8/1997 | Maas et al. |
| 5,660,153 | A | 8/1997 | Hampton et al. |
| 5,669,342 | A | 9/1997 | Speil |
| 5,682,848 | A | 11/1997 | Hampton et al. |
| 5,709,180 | A | 1/1998 | Spath |
| 5,720,244 | A | 2/1998 | Faria |
| 5,782,216 | A | 7/1998 | Haas et al. |
| 5,803,040 | A | 9/1998 | Biesinger et al. |
| 5,832,884 | A | 11/1998 | Haas et al. |
| 5,875,748 | A | 3/1999 | Haas et al. |
| 5,893,344 | A | 4/1999 | Church |
| 5,934,232 | A | 8/1999 | Greene et al. |
| 6,032,643 | A | 3/2000 | Hosaka et al. |
| 6,053,133 | A | 4/2000 | Faria et al. |
| 6,092,497 | A | 7/2000 | Preston et al. |
| 6,095,696 | A | 8/2000 | Foldi |
| 6,164,255 | A | 12/2000 | Maas et al. |
| 6,196,175 | B1 | 3/2001 | Church |
| 6,213,076 | B1 | 4/2001 | Fischer et al. |
| 6,244,229 | B1 | 6/2001 | Nakano et al. |
| 6,247,433 | B1 | 6/2001 | Faria |
| 6,257,185 | B1 | 7/2001 | Groh et al. |
| 6,273,039 | B1 | 8/2001 | Church |
| 6,318,324 | B1 | 11/2001 | Koeroghlian et al. |
| 6,321,704 | B1 | 11/2001 | Church et al. |
| 6,321,705 | B1 | 11/2001 | Fernandez et al. |
| 6,325,030 | B1 | 12/2001 | Spath et al. |
| 6,345,596 | B1 | 2/2002 | Kuhl |
| 6,405,699 | B1 | 6/2002 | Church |
| 6,412,460 | B1 | 7/2002 | Sato et al. |
| 6,425,358 | B1 | 7/2002 | Haas et al. |
| 6,427,652 | B2 | 8/2002 | Faria et al. |
| 6,439,176 | B1 | 8/2002 | Payne et al. |
| 6,460,499 | B1 | 10/2002 | Mason et al. |
| 6,477,997 | B1 | 11/2002 | Wakeman |
| 6,497,207 | B2 | 12/2002 | Spath et al. |
| 6,513,470 | B1 | 2/2003 | Hendriksma et al. |
| 6,578,535 | B2 | 6/2003 | Spath et al. |
| 6,588,394 | B2 | 7/2003 | Zheng |
| 6,591,796 | B1 | 7/2003 | Scott |
| 6,595,174 | B2 | 7/2003 | Schnell |
| 6,606,972 | B2 | 8/2003 | Wenisch et al. |
| 6,615,783 | B2 | 9/2003 | Haas et al. |
| 6,668,776 | B2 | 12/2003 | Hendriksma et al. |
| 6,745,737 | B2 | 6/2004 | Evans et al. |
| 6,748,914 | B2 | 6/2004 | Spath et al. |
| 6,814,040 | B2 | 11/2004 | Hendriksma et al. |
| 6,866,014 | B2 | 3/2005 | Spath et al. |
| 6,901,893 | B1 | 6/2005 | Gumpher |
| 7,104,232 | B2 | 9/2006 | Hendriksma et al. |
| 7,210,439 | B2 | 5/2007 | Geyer et al. |
| 7,263,956 | B2 | 9/2007 | Spath et al. |
| 7,296,548 | B2 | 11/2007 | Hendriksma et al. |
| 7,308,879 | B2 | 12/2007 | Hendriksma et al. |
| 7,395,792 | B2 | 7/2008 | Hendriksma et al. |
| 7,464,680 | B2 | 12/2008 | Geyer et al. |
| 2006/0191503 | A1* | 8/2006 | Geyer et al. ..... 123/90.15 |
| 2007/0295293 | A1 | 12/2007 | Spath et al. |
| 2008/0289597 | A1 | 11/2008 | Hendriksma et al. |

FOREIGN PATENT DOCUMENTS

| | | |
|---|---|---|
| WO | WO 03067038 | 1/2003 |

OTHER PUBLICATIONS

Sandford, et al, "Reduced Fuel Consumption & Emissions Through Cylinder Deactivation," Mercedes-Benz S-Class—Motorization—Aachener Kolloquium Fahzeug, p. 1017-1027 (1998).

"Design Practice Standards," Mar. 14, 2005, p. 1, in German with English Translation.

* cited by examiner

APPARATUS AND METHOD FOR SETTING MECHANICAL LASH IN A VALVE-DEACTIVATING HYDRAULIC LASH ADJUSTER

TECHNICAL FIELD

The present invention relates to valve train members such as hydraulic lash adjusters (HLAs) for supporting roller finger followers in overhead-camshaft valvetrains in internal combustion engines; more particularly, to such HLAs having means for selectively engaging and disengaging activation of valves in valvetrains; and most particularly, to apparatus and method for setting internal mechanical lash in a deactivating hydraulic lash adjuster (DHLA).

BACKGROUND OF THE INVENTION

It is well known that overall fuel efficiency in a multiple-cylinder internal combustion engine can be increased by selective deactivation of one or more of the engine valves, under certain engine load conditions. For example, for an overhead-cam engine, a known approach to providing selective deactivation is to equip a valvetrain member such as the hydraulic lash adjusters for the overhead-cam engine valvetrains with means whereby the roller finger followers (RFFs) may be rendered incapable of transferring the cyclic motion of engine cams into reciprocal motion of the associated valves. Typically, a DHLA includes, in addition to the conventional hydraulic lash adjuster, a concentric inner pin housing and outer HLA body which are mechanically responsive to the force of the RFF as exerted by the cam lobe, and which may be selectively latched and unlatched hydromechanically to each other, typically by the selective engagement of pressurized engine oil on locking pins.

An important consideration in a DHLA is the amount of internal mechanical lash deliberately incorporated into the DHLA. In prior art DHLAs, a transverse bore in the pin housing contains the two opposed locking pins which are urged outwards of the pin housing by a pin-locking spring disposed in compression therebetween to engage a first annular groove including a locking surface (also referred to herein as "pin shelf") in the inner wall of the HLA body whereby the HLA body and the pin housing are locked together to produce reciprocal motion of an RFF disposed on the DHLA. When valve deactivation is desired, the pins are withdrawn from the DHLA body by application of hydraulic fluid such as engine oil to the outer ends of the pins at pressure sufficient to overcome the force of the pin-locking spring.

Prior art DHLAs also are assembled from a top end of the DHLA body (which is closed at its bottom end) by insertion of components through the open top end and securing the components with one or more retaining rings into a second annular groove formed in the inner wall of the DHLA body near the open end thereof. The rings used to secure the components also serve to set internal mechanical lash in the DHLA by the selection of rings of appropriate thickness during assembly of the DHLA. Thus, the rings act as a mechanical stop to limit the outward motion of the pin housing prior to engagement and disengagement of the locking pins. With the lost motion springs applying an upward force on the pin housing to force the top surface of the ring against the top of the annular groove, the lash rings permit the pin housing to travel to a position wherein the locking pins can clear the bottom surface, or pin shelf, of the locking groove in the DHLA body by a small amount, typically about 0.005 inches or less. Excess clearance or internal mechanical lash results in clatter and wear of the DHLA during engine operation. Variations in internal mechanical lash can also adversely affect the opening and/or closing timing of the associated valve. Thus, the axial position of the underside of the retaining rings with respect to the locking groove pin shelf is of critical importance.

Typically, because of variation in manufacturing tolerances of the body, pin housing, and pins, the correct lash is obtained only by iterative trial and measurement using lash-adjusting rings of differing thicknesses. Setting the lash in this fashion is difficult and complicated. Moreover, since setting lash in this fashion relies on the machined integrity of the top surface of the annular groove, machining difficulties inherent in forming the top surface of the groove can result in unnecessary variances in mechanical lash settings.

What is needed in the art is an improved DHLA wherein components are easily assembled and wherein mechanical lash is easily set in a single, simple procedure.

It is a principal object of the present invention to reduce the cost and complexity of an improved DHLA, and to improve the ease and reliability of assembly thereof.

SUMMARY OF THE INVENTION

Briefly described, a DHLA in accordance with the present invention comprises a conventional hydraulic lash adjustment mechanism within a plunger slidably disposed within a pin housing that is slidably disposed within an axial bore in an adjuster body. A transverse bore in the pin housing contains two opposed, selectively-retractable locking pins that engage a lower annular groove including a locking surface in the adjuster body whereby the lash adjuster body and the pin housing are locked together for mutual actuation by rotary motion of the cam lobe to produce reciprocal motion of an engine RFF pivotably disposed on a domed head of the plunger.

A lash ring disposed in an annular groove near the outer end of the DHLA body includes a first portion extending into the bore in the DHLA body to engage the pin housing. The lash ring thus functions to limit the travel of the pin housing within the DHLA body and thereby sets the internal mechanical lash in the deactivation mechanism. The first portion of the lash ring has a thickness selected to provide a predetermined amount of mechanical lash in the assembled lifter to ensure facile engagement and disengagement of the locking pins in the lifter body. Preferably, the lash ring is provided as a single ring having a first portion of a desired thickness, which thickness varies from assembly to assembly to compensate for manufacturing variation in the components. A biasing means is also installed in the second annular groove to urge the lash ring against the lower face of the groove under all DHLA operating conditions.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
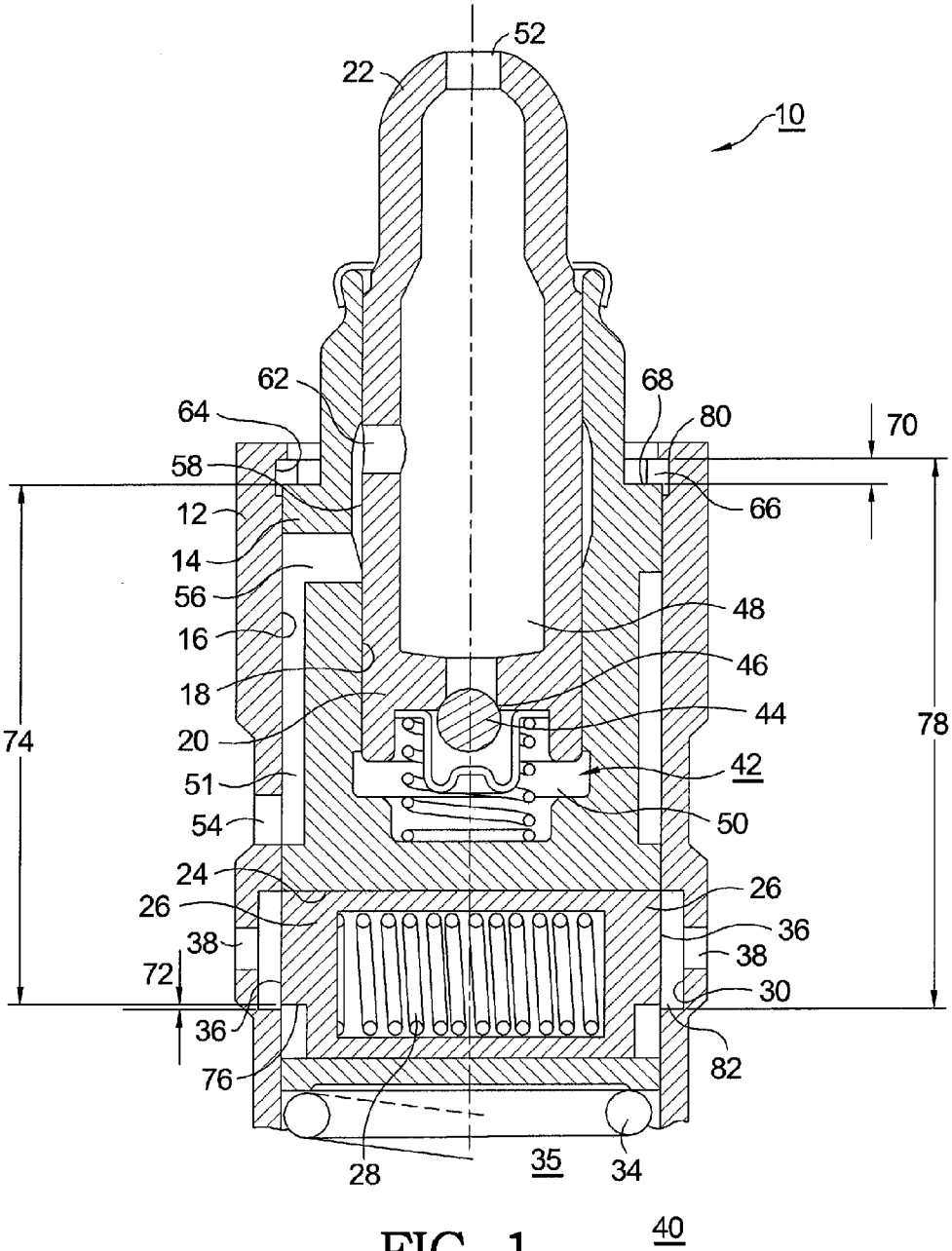
FIG. 1. (PRIOR ART)
FIG. 1 is an elevational cross-sectional view of an upper portion of a prior art valve-deactivating hydraulic lash adjuster for use in an overhead-camshaft internal combustion engine, showing the pin housing retained by a lash clip disposed in an annular groove in the inner wall of the DHLA body.
Figure 3:
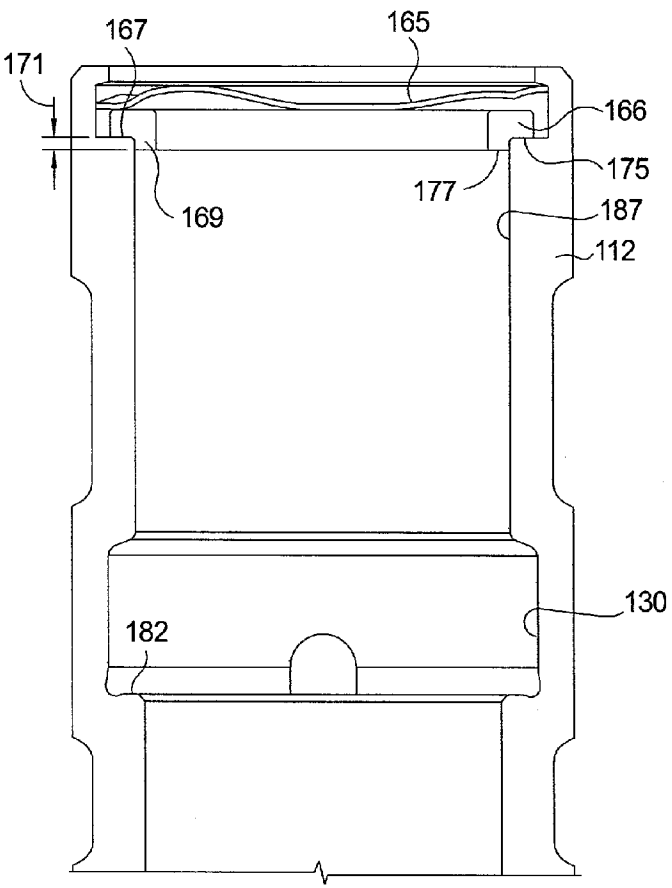
FIG. 3 is an elevational cross-sectional view showing the DHLA body portion shown in FIG. 2 with the addition of an operational lash ring and a wave spring in an annular groove in accordance with the present invention.

Referring to FIG. 1, a prior art DHLA 10 has a generally cylindrical adjuster body 12. A pin housing 14 is slidably disposed within a first axial bore 16 in adjuster body 12. Pin housing 14 itself has a second axial bore 18 for slidably receiving a plunger 20 having a domed end 22 for receiving a socket end (not shown) of a roller finger follower (not shown) in an overhead-cam engine valve train (not shown). Pin housing 14 has a transverse bore 24 slidably receivable of two opposed locking pins 26 separated by a pin-locking spring 28 disposed in compression therebetween. First axial bore 16 in is adjuster body 12 is provided with an annular groove 30 for receiving the outer ends of locking pins 26, thrust outwards by spring 28 when pins 26 are axially aligned with groove 30. In such configuration, DHLA 10 is in valve-activation mode. (As shown in FIG. 1, DHLA 10 is in valve-deactivation mode.) A loss-of-motion (LM) return spring 34 is disposed within a chamber 35 below pin housing for absorbing lost motion of pin housing 14 within bore 16 when DHLA 10 is in deactivation mode.

Groove 30 further defines a reservoir for providing high pressure oil against the outer ends 36 of locking pins 26 to overcome spring 28 and retract the locking pins into bore 24, thereby unlocking the pin housing from the adjuster body to deactivate the DHLA. In use, groove 30 is in communication via at least one port 38 with an oil gallery (not shown) in an engine 40, which in turn is supplied with high pressure oil by an engine control module (not shown) under predetermined engine parameters in which deactivation of valves is desired.

Plunger 20 includes a hydraulic element assembly (HEA) 42 lodged at an inner end thereof. The arrangement of components and operation of hydraulic lash adjuster elements such as HEA 42 has been well known in the prior art for many years. HEA 42 comprises a spring loaded check ball 44 lodged against a seat 46 formed in plunger 20 separating a low-pressure oil reservoir 48 from a high-pressure chamber 50 formed between HEA 42 and pin housing 14. Oil is supplied to annular chamber 51 from an engine oil gallery (not shown) via port 54 in adjuster body 12. Chamber 51 is also in communication with reservoir 48 via port 56 and annular groove 58 in pin housing 14 and port 62 in plunger 20. Oil may be supplied from reservoir 48 to an associated roller finger follower (not shown) via port 52 in the end 22 of plunger 20.

In operation, prior art DHLA 10 is disposed in a bore in engine 40 such that housing 12 remains stationary. When the associated cam and RFF (not shown) exert force on plunger end 22, in lost motion (valve-deactivation) mode, plunger 20 and pin housing 14 are forced into adjuster body 12 in a lost-motion stroke, compressing spring 34.

Of particular interest to the present invention is the means by which the outward stroke of pin housing 14 is limited in prior art body 12. An annular groove 64 formed in bore 16 near the outer end thereof receives a retaining clip 66 that extends into bore 66 to engage shoulder 68 of pin housing 14. The axial thickness 70 of clip 16 is selected from a family of such clips having differing thicknesses to set the amount of axial mechanical lash 72 in DHLA 10. As described above, the amount of lash 72 is an important manufacturing parameter which must be calibrated for each DHLA assembly because of manufacturing variability in the length 74 from shoulder 68 to the lower edge 76 of pins 26, and length 78 from the upper face 80 of groove 64 to the lower face 82 of groove 30. (Lower face 82 is also known in the art as a "pin shelf" for lock pins 26.) The trial-and-error method of assembly, measurement, disassembly, reassembly, and re-measurement is time-consuming, costly, and difficult when using prior art groove 64 and clip 66.

Referring to FIGS. 2 through 5, an improved DHLA 110 in accordance with the present invention is formed substantially like prior art having similar components except as follows.

As described above, the amount of mechanical lash 172 (also referred herein as desired mechanical lash) is an important manufacturing parameter which must be calibrated for each DHLA assembly because of manufacturing variability in the length 174 from shoulder 168 of pin housing 114 to the lower edge 176 of locking pins 126.

A lash ring 166, of a selectable size, is retained in groove 164 in body 112 by a resilient biasing member 165 such as a Belleville washer, or preferably a wave ring. Lash ring 166 includes a first portion such a collar 169 having a length 171, and first and second surfaces 175, 177.

After pin housing 114 is installed in body 112 as in the prior art, a method for setting mechanical lash in an individual DHLA 110 consists in the following steps.

Figure 6A:
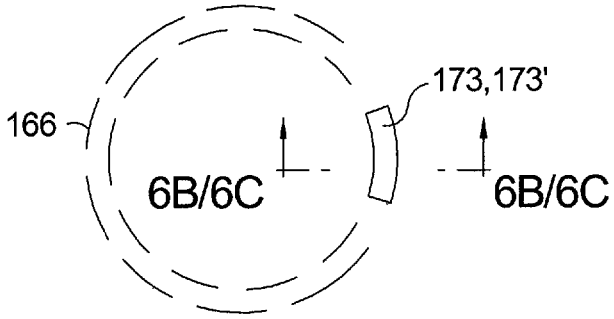
FIG. 6*a* is a top view of an exemplar gage tool, in accordance with the invention, superimposed on a profile of the offset lash ring shown in FIGS. 3-5.
Figure 6B:
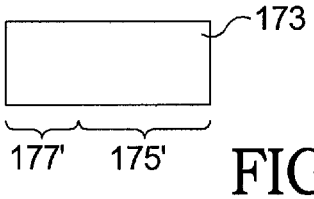
FIGS. 6*b* and 6*c* are enlarged cross-sections of two exemplar gage tools, in accordance with the invention, taken along line 6B/6C-6B/6C of FIG. 6*a*.
Figure 6C:
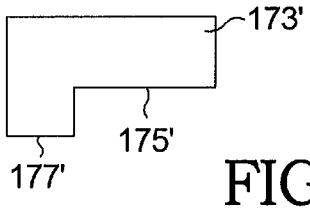

First, a gage tool 173, 173' (FIG. 6*a*), designed to simulate at least a portion of lash ring 166 (shown as dashed lines in FIG. 6*a*), and having exemplary cross sections as shown in FIGS. 6*b* and 6*c*, is positioned in first annular groove 164 with its first surface 175' positioned against the bottom surface 167 of annular groove 164 and its second surface 177' in abutting contact with shoulder 168 of pin housing 114, thereby establishing a known, fixed axial relationship between bottom face 167 of groove 164 and shoulder 168 of pin housing 114. (When using gage tool 173 in which surfaces 175' and 177' are collinear, bottom face 167 and shoulder 168 will be collinear as well). Pin housing 114 is then depressed into body 112 until locking pins 126 engage lower face 182 of groove 130 with a specified force. A longitudinal distance D in which pin housing 114 travels from its starting position of being in contact with second surface 177' to its ending position of wherein locking pins 126 engage lower face 182 is observed. Then, desired lash 172 is subtracted from observed distance D. The numerical remainder (D−172) is used to determine length 171 of first portion 169 of lash ring 166 that will result in the desired lash 172. After gage tool 173, 173' is removed from groove 164, a lash ring 166 having a selected length 171 of first portion 169 as determined above is installed in groove 164 with second surface 177 facing shoulder 168 of pin housing 114. Finally, wave ring 165 is installed on top of lash ring 166 to retain ring 166 in annular groove 164 and to preload lash ring 166 against bottom surface 167 of annular groove 164.

Wave ring 165 is selected to preload lash ring 166 and to apply a clamping force on lash ring 166 that is greater than the installed load of the lost motion spring(s) 134 to keep lash ring 166 seated against bottom surface 167 of groove 164 during use of DHLA 110. Suitable wave rings are commercially available from, for example, Smalley Steel Ring Co, Inc., Lake Zurich, Ill., USA. Alternatively, a Belleville washer may be used, such as is available from Mubea Inc., Florence, Ky., USA.

The improved arrangement in accordance with the present invention changes the precision feature of ring groove 164 to bottom surface 167 rather than the top face 180 as in the prior art (FIG. 1). This represents an important manufacturing improvement; top face 180 is difficult to grind as it requires a grind relief in the upper corner of the groove. Also, top face 180 cannot be machined simultaneously with lower face 182 so tolerances cannot be controlled as precisely. In improved DHLA 110, bottom surface 167 is the key surface and can be machined with tooling similar to that used for lower face/pin shelf 182. Also, bottom surface 167 may be machined simultaneously with pin shelf 182 to precisely establish length 178 (FIG. 2) thereby reducing the variation that the lash ring thickness must accommodate.

Figure 2:
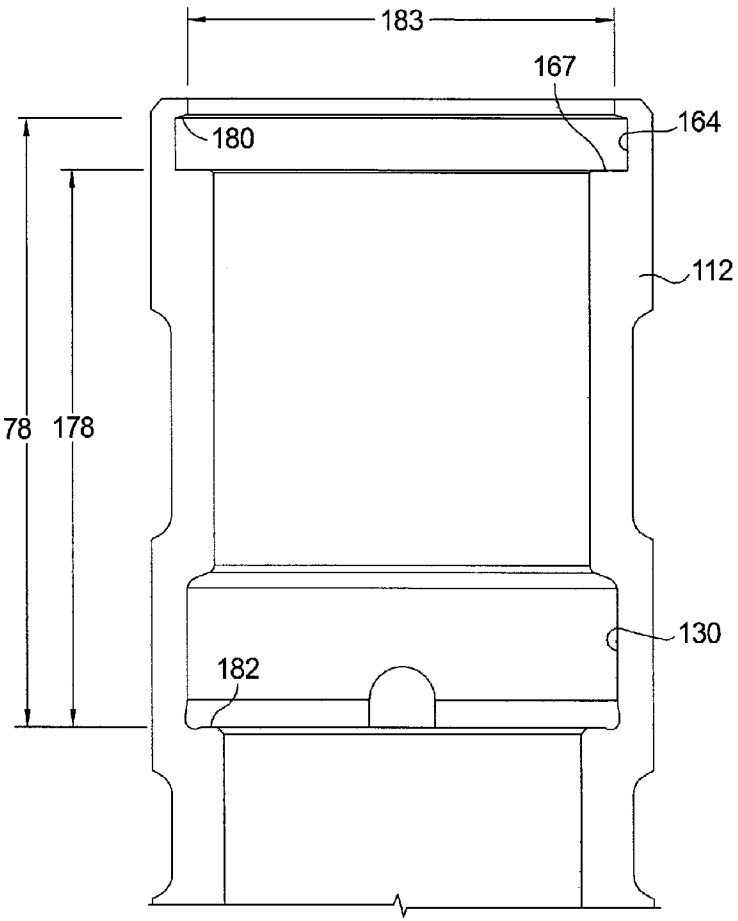
FIG. 2 is an elevational cross-sectional view of a portion of a DHLA body in accordance with the present invention.
Figure 4:
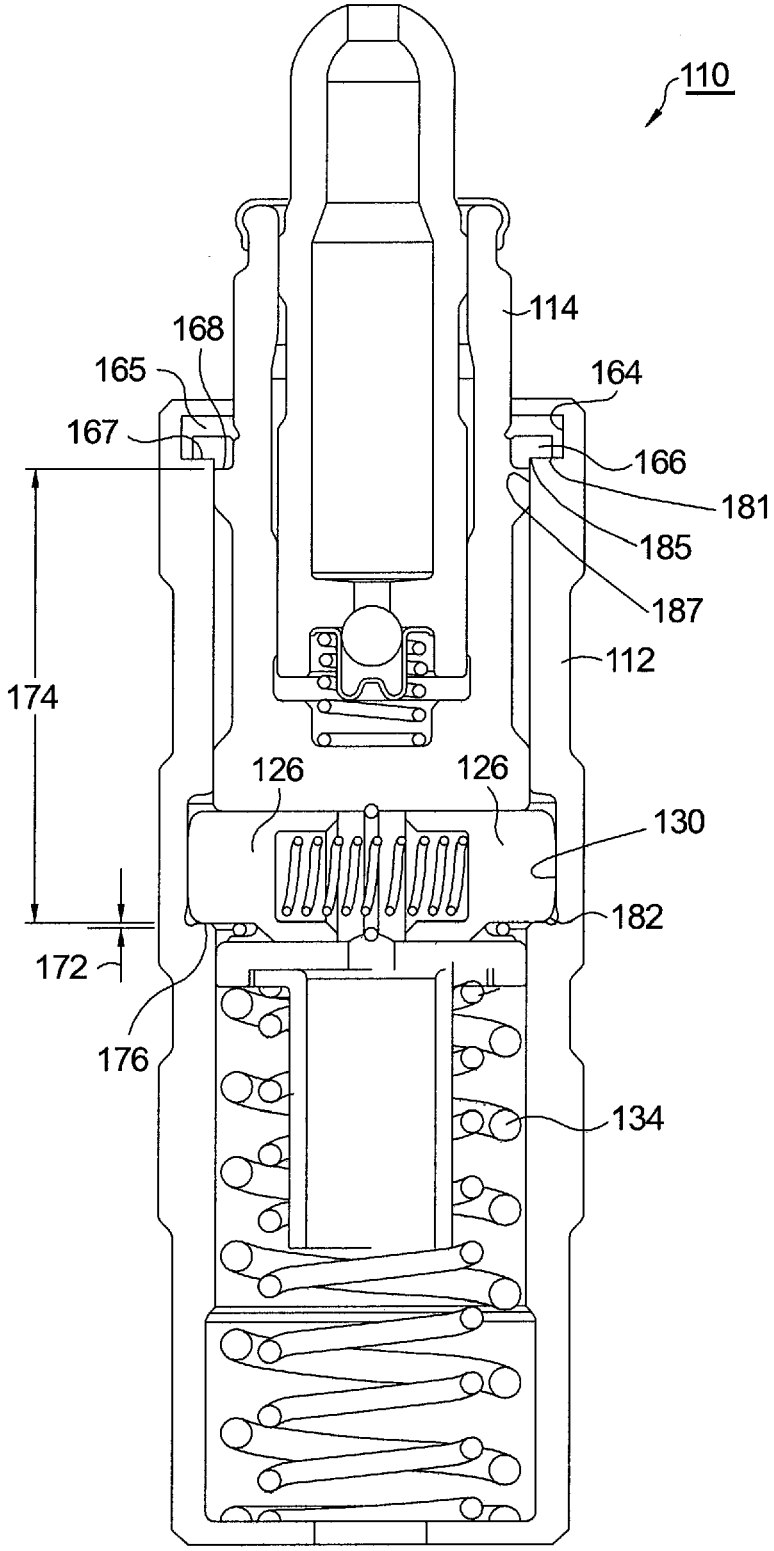
FIG. 4 is an elevational cross-sectional view of a complete DHLA in accordance with the present invention.
Figure 5:
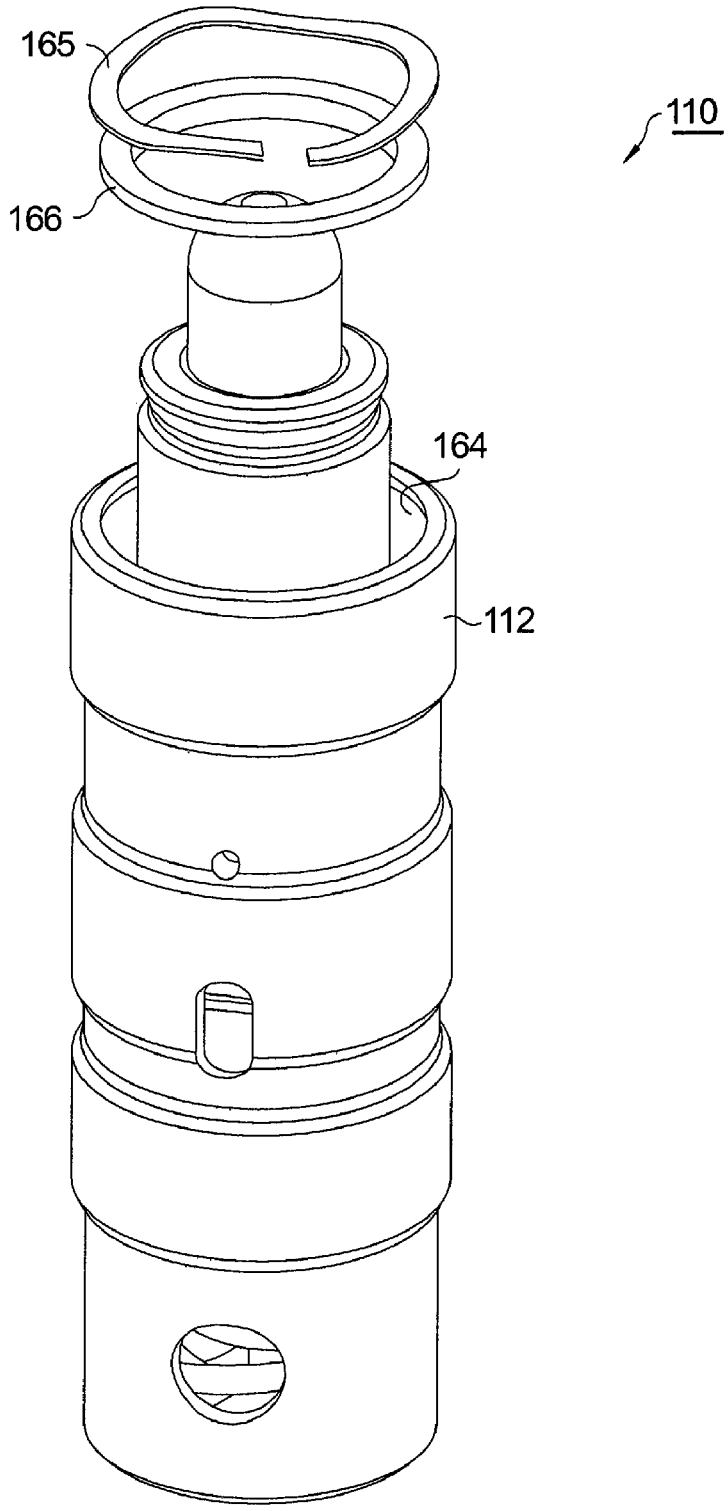
FIG. 5 is a partially exploded isometric view of the complete DHLA shown in FIG. 4.

Note also that preferably, the outer diameter 181 of lash ring 166 is less than the inner diameter 183 of the opening of body 112 (FIG. 2). Thus, ring 166 need not be radially compressed to fit into second groove 164 thereby avoiding the risk of distorting the flatness of ring 166 and introducing error in the resulting mechanical lash 172. Also, preferably, outside diameter 185 of second surface 177 of lash ring 166 pilots on the inside diameter 187 of body 112.

Figure 7:
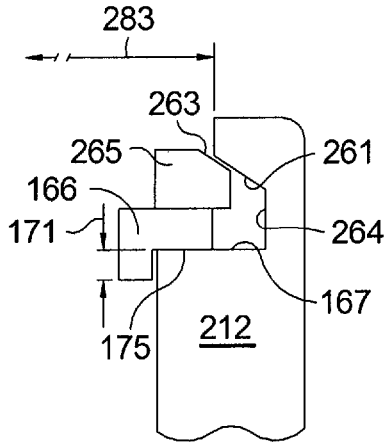
FIG. 7 is a partial view of an upper portion of a body and pin housing showing a lash ring and a biasing member of a second embodiment, in accordance with the invention.

In an alternate embodiment, wave ring 165 may be substituted with internal split beveled retaining ring 265 as shown in FIG. 7, commercially available from Rotor Clip Company, Inc. of Somerset, N.J. 08873. In this embodiment, surface 263 of split ring 265 is formed with a 15° bevel for mating with a 15° bevel formed in the upper face 261 of groove 264. After lash ring 166 having a selected length 171 as determined above is installed in groove 264, split ring 265 is radially compressed so that its outer diameter fits inside inner diameter 283 of the opening of body 212. Then, split ring 265 is allowed to radially expand into groove 264 so that surface 263 of split ring 265 wedges against upper face 261 of groove 264 thereby firmly pre-loading and seating first surface 175 of lash ring 166 against bottom surface 167 of groove 264.

While the invention described herein relates to setting of the mechanical lash of a DHLA, it is understood that the invention may be used in any deactivating valvetrain member such as, for example, a deactivating valve lifter.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A deactivating valvetrain member used in an internal combustion engine, comprising:

a) a body having an axial bore, and having a first groove in said axial bore, said first groove defining a lower groove surface;

b) a housing slidably disposed in said axial bore for axial displacement;

c) a first biasing member urging said housing in a first axial direction;

d) a locking mechanism for selectively limiting said axial displacement of said housing;

e) a lash ring disposed in said first groove and having a first portion extending into said axial bore, said first portion configured to limit travel of said housing in said first direction, wherein a dimension of said first portion is selected to provide a predetermined amount of internal mechanical lash in said deactivating valve train member; and f) a second biasing member disposed adjacent said lash ring in said first groove for urging said lash ring against said lower groove surface in a second direction opposite said first direction.

2. A deactivating valvetrain member in accordance with claim 1 wherein said second biasing member is selected from the group consisting of wave spring and Belleville washer.

3. A deactivating valvetrain member in accordance with claim 1 wherein said second biasing member is formed of a resilient material.

4. A deactivating valvetrain member in accordance with claim 1 wherein said second biasing member includes a beveled surface for mating engagement with a beveled face of said first groove.

5. A deactivating valvetrain member in accordance with claim 1 wherein said body further comprises a second groove in said axial bore offspaced from said first groove, said second groove defining a pin shelf, wherein said housing includes a transverse bore therethrough, and wherein said locking mechanism comprises a locking pin slidably disposed in said transverse bore, said locking pin including an outer end for selectively engaging said pin shelf.

6. A deactivating valvetrain member in accordance with claim 1 wherein said first biasing member comprises a lost motion spring compressively disposed for urging relative motion between said body and said housing.

7. A deactivating valve train member in accordance with claim 6 wherein at least a portion of said lost motion spring is disposed below said pin housing.

8. A method for setting mechanical lash of deactivating valve train member wherein said member includes a locking mechanism, said method comprising the steps of:

a) installing a housing into an axial bore in a body of said valve train member;

b) installing a gage tool into said axial bore, said tool making contact with both a lower surface of a first groove in said axial bore and a shoulder of said housing;

c) loading said gage tool against said lower surface of said first groove and determining a first axial position of said housing relative to said body;

d) depressing said housing into said body in a first direction against a first biasing member until travel of said housing in said first direction is limited by said locking mechanism and a predetermined force is generated against said housing e) determining a second axial position of said housing relative to said body;

d) selecting a desired mechanical lash in said valve train member;

e) calculating a desired thickness for an operational lash ring that will produce said desired mechanical lash;

f) installing said operational lash ring into said first groove; and g) installing a biasing member adjacent said operational lash ring to urge said lash ring in a second direction against said lower surface of said first groove to yield said desired amount of mechanical lash.

9. A method in accordance with claim 8 wherein, in said depressing step, a locking pin of said locking mechanism makes contact with a pin shelf of a second groove in said axial bore for limiting said travel of said housing in said first direction.

10. An internal combustion engine comprising a deactivating valvetrain member said valve train member including a body having an axial bore and having a groove in said axial bore, said groove defining a lower groove surface, a housing slidably disposed in said axial bore for axial displacement, a first biasing member urging said housing in a first axial direction, a locking mechanism for selectively limiting said axial displacement of said housing, a lash ring disposed in said groove and having a first portion extending into said axial bore, said first portion configured to limit travel of said housing in said first direction, wherein a dimension of said first portion is selected to provide a predetermined amount of internal mechanical lash in said deactivating valve train member, and a second biasing member disposed adjacent said lash ring in said groove for urging said lash ring against said lower groove surface in a second direction opposite said first direction.

* * * * *